US008196772B2

(12) United States Patent
Leon et al.

(10) Patent No.: US 8,196,772 B2
(45) Date of Patent: Jun. 12, 2012

(54) DISPOSABLE BEVERAGE CUP WITH LID ISOLATION SYSTEM

(76) Inventors: Richard Joseph Leon, Oceanside, CA (US); David W. McGinnis, Albuquerque, NM (US)

( * ) Notice: Subject to any disclaimer, the term of this patent is extended or adjusted under 35 U.S.C. 154(b) by 462 days.

(21) Appl. No.: 12/386,416

(22) Filed: Apr. 17, 2009

(65) Prior Publication Data

US 2010/0264150 A1 Oct. 21, 2010

(51) Int. Cl.
*B65D 8/04* (2006.01)
*B65D 3/00* (2006.01)
*A47G 19/22* (2006.01)

(52) U.S. Cl. ..... 220/669; 220/675; 220/703; 220/710.5; 220/758; 220/771; 229/400; 229/402

(58) Field of Classification Search ..... 220/675, 220/669, 703, 710.5, 752, 755, 758, 771; 229/400, 402
See application file for complete search history.

(56) References Cited

U.S. PATENT DOCUMENTS

| | | | | |
|---|---|---|---|---|
| 3,094,240 | A * | 6/1963 | Wanderer | 206/519 |
| 6,056,144 | A * | 5/2000 | Strange et al. | 220/297 |
| 6,588,654 | B2 * | 7/2003 | Nakashima | 229/402 |
| 6,688,487 | B2 * | 2/2004 | Oakes et al. | 220/788 |

* cited by examiner

*Primary Examiner* — Anthony Stashick
*Assistant Examiner* — Madison L Wright
(74) *Attorney, Agent, or Firm* — Bauman, Dow, Leon, P.C.; Alberto A. Leon, Esq.

(57) ABSTRACT

The invention comprises a disposable beverage cup that comprises a ledge between the cup's rim and the grasping portion of the cup that is commonly held in the user's hand. The ledge, which comprises a curb, a horizontal plane, and one or more indentations, acts as a barrier between the user's hand and other objects, preventing a lid that has been press fit onto the cup's rim from being dislodged. In order to remove the lid, the user must insert a finger and/or thumb into the indentation(s) and press upward on the lid. The cup has a contour between the ledge and the grasping portion with ergonomic features to increase the user's comfort in handling the cup.

2 Claims, 8 Drawing Sheets

DISPOSABLE BEVERAGE CUP WITH LID ISOLATION SYSTEM

STATEMENT REGARDING FEDERALLY SPONSORED RESEARCH AND DEVELOPMENT

Not applicable

THE NAMES OF THE PARTIES TO A JOINT RESEARCH AGREEMENT

Not applicable

INCORPORATION-BY-REFERENCE OF MATERIAL SUBMITTED ON A COMPACT DISC

Not applicable

BACKGROUND OF THE INVENTION

1. Field of the Invention

The present invention pertains generally to containers, and more particularly to beverage containers and even more specifically to disposable beverage cups.

2. Description of the Related Art, Including Information Disclosed Under 37 CFR 1.97 and 37 CFR 1.98

Early in the 20th century, people commonly shared glasses or dippers at water sources such as school faucets or water barrels in trains. Obviously, especially at a time when the means to prevent transmission of common ailments were very limited, the shared use of glasses or dippers caused public health concerns. Lafayette College biology professor Alvin Davidson conducted one of the seminal investigations into the shared use of beverage containers. In 1908, Technical World Magazine published Dr. Davidson's study with the sensational title "Death in School Drinking Cups." Dr. Davidson's findings were based on research carried out in Easton, Pa.'s public schools.

Sharing water sources through shared containers was ultimately banned after the invention of the DIXIE CUP® disposable drinking cup in 1908, when cheap and sanitary disposable cups became available. Early in the development of the disposable cup, it became obvious that they could be very useful in many settings, including hospitals. It was determined that the cost of cleaning glass cups for reuse was almost double than using the disposable cups available at the time.

Originally, paper cups for hot drinks were glued together and made waterproof by dropping a small amount of clay in the bottom of the cup, and then spinning at high speed so that clay would travel up the walls of the cup, making the paper water-resistant. However, that process resulted in drinks smelling and tasting of cardboard. Cups for cold drinks could not be treated in the same way, as condensation formed on the outside, soaking into the board and making the cup unstable. To remedy that shortcoming, cup manufacturers developed the technique of spraying both the inside and outside of the cup with wax.

Both clay-coated and wax-coated cups disappeared with the invention of polyethylene (PE) coated cups. That process covers the surface of the board with a very thin layer of PE, not only waterproofing the board, but also welding the cup's seams together. The modern widely used paper cup is made from natural organic resins such as wood fiber.

Later on the development and use of disposable hot beverage cups, it became important to utilize materials with thermal insulating properties. Accordingly the most commonly used "modern" hot beverage cups are made from two basic materials: (1) expanded styrene resin; and (2) paper.

Expanded polystyrene resin (a synthetic resin produced chemically), known as Styrofoam®, has excellent thermal insulating properties. Further, the cup-wall strength can be controlled at the manufacturing point and varies according to resin density. The Styrofoam® cup's wall strength can be further enhanced by laminating the outside of the cup wall with paper.

Paper cups' low thermal insulating characteristics can also be enhanced by slipping common multi-layered paper insulating sleeves over the outside of the paper cups. At least one of the paper laminations of the sleeve is generally corrugated to create air space between the consumer's hand and the outer surface of the paper cup to increase thermal insulation between hand and cup. The disadvantage of this combination of two paper products is that the sleeve is a loose slip fit that is cumbersome and poses a safety hazard. Even sleeves that are made with a small deposit of thermal activated adhesive on their inner surface fail to effectively and permanently attach the sleeve to the cup.

From the perspective of safely holding a cup containing a hot liquid, Styrofoam cups appear to present the better alternative. At this point in the development of safe, monolithic and thermal insulating cups, the cost of design and production, especially the raw material costs appear to be a major obstacle. It should be noted, however, that there are a number of materials that could be used in high volumes resulting in a commercially viable and affordable thermal insulating cup. The present invention combines the use of materials with optimal thermal insulating properties and costs, and the resulting optimal ergonomic properties.

Ergonomics is defined by Webster as: (1) an applied science concerned with designing and arranging things people use so that the people and things interact most efficiently and safely—also called biotechnology, human engineering, human factors; (2) the design characteristics of an object resulting especially from the application of the science of ergonomics. The present invention comprises a device and method which utilize several available materials and conventional manufacturing and fabrication means, and improvements thereof. The essence of the present invention, therefore, is the fact that it provides the geometrical and physical boundaries for manufacturers to use alternative materials and produce an environmentally friendly, seamless and ergonomically efficient cup. Obviously, the choice of materials is driven by manufacturing and environmental concerns. However, the present invention can achieve a viable, seamless cup with optimal geometrical and ergonomic properties.

There are many reasons for concern by manufacturers, retailers and customers over what is the optimal material for making disposable beverage cups. There is a growing demand for environmentally friendly or "green" disposable materials that are biodegradable or compostable. That demand provides an incentive for innovative materials that could ultimately displace expanded resin as a widely used packaging and container base stock material. Years ago before greenhouse emissions became such a huge concern, public attention was focused on the environmental effect of manufactured materials on the earthen material in and around landfills and on the ground water contaminated by leeching of the buried manufactured materials. Attention to environmental impact, therefore, centered on what happens below the ground surface. It is well known that Styrofoam®, which comprises expanded plastic resin made from nonrenewable crude oil stock, might not decompose thus becoming a waste burial threat in the ground. Common paper cups were not seen as much of a threat to the environment because they eventually decompose when buried in the ground and were biodegradable because they were made from wood pulp containing natural resin or fiber. But then public focus increased dramatically on greenhouse gases being produced and released into our atmosphere above the ground. Now, some experts and public lobby groups are arguing that the manufacture of Styrofoam® and its fabrication into a drinking cup release far less greenhouse gas into the atmosphere than the amount of methane ($CH_4$) produced in the manufacture of a paper cup and in its decomposition when buried in the ground. Volume for volume, methane is one of the greatest threats of all gases when released into the atmosphere, trapping heat and thereby increasing global warming. Because of the mixed bag of advantages and disadvantages, it is hard to predict whether Styrofoam® or paper products will be determined to be the environmentally friendly food container material of choice.

Natural resins processed from corn, banana plant, bamboo, hemp, cotton and recycled paper are emerging alternatives to just wood by itself as a base fiber stock material for fabrication of paper cups. Paper is made from such alternative fibers throughout the world. Paper is recyclable more than once. It is also biodegradable and compostable, so is environmentally friendly. In time, expanded polystyrene could be replaced by expanded (foamed) vegetable fiber that is expanded and stabilized with naturally occurring starches and proteins. There are several nontoxic foaming agents that can expand a fibrous solution. The expanded and stabilized fibrous solution would then dry and solidify within a predictable molding volume. Synthetic resin or natural fiber, flat or expanded, are logical material types that can be formed into the solid, monolithic, seamless geometry of this invention as can any plausible material.

Starting with the rapidly gained popularity and high volume output of the fast-food industry, the need for disposable beverage cups with lids became evident. The inception of drive-up window service usually associated with the fast-food industry made the safe containment of beverages, especially hot beverages, an important requirement. A cup without a lid is potentially unsafe in the pedestrian and vehicular travel modes. The safe manipulation of a beverage cup for drinking without spilling is an important requirement, necessitating a lid. However, there has not been much, if any, significant improvement in the container, i.e., the lid and cup, from the standpoint of the consumer's ability to manipulate and handle the container without spilling the beverage.

A disposable lid for a disposable beverage cup is commonly a flat plastic disc with a skirt around its perimeter. The skirt snap fits onto the top of a beverage cup. Lids comprise either an opening near the perimeter of the lid for drinking directly from the cup or a circular opening in the lid's center through which a straw can be inserted. Some variations, such as hemispherical lids, are also commercially available. However the problem with each variation is the same: the snap fit of the lid over the top of a disposable beverage cup results in the lid's skirt not being flush with the cup. Because the skirt of the lid sticks out from the sides of the beverage cup, there is an increased likelihood of the lid becoming detached from the beverage cup if there is any upward pressure on the lid's ridge. This pressure could come from the consumer's hand, a vehicle's beverage holder or a number of other sources.

A disposable beverage cup without a lid containing a hot beverage such as coffee or tea is a potential safety hazard to the consumer handling the cup and to people and environment around the consumer. However, a disposable beverage cup with a lid affixed to it is equally hazardous if the lid is inadvertently and suddenly detached, causing spillage of hot beverage onto the consumer and possibly onto other people in the consumer's immediate vicinity. Two effects of lid attachment commonly occur: First, the cup is suddenly opened and beverage spillage occurs; and second, the consumer's hand-grip suddenly strengthens on the lidless cup causing it to compress, thereby erupting the beverage out of the cup. The exposed lid skirt can also be inadvertently struck against any object while the cup and lid assembly is in motion for transport from, for example, a store counter to a table or to an automobile in a drive-up service mode.

The present invention solves the problem of lids becoming detached from disposable beverage cups by adding structural characteristics to the cup that guard the lid skirt edge against most inadvertent and accidental lid detachment while providing a means for controlled, safer lid removal from the cup.

BRIEF SUMMARY OF THE INVENTION

The present invention is not material specific. Instead, it comprises a means to enhance the human hand grip, safety and physical integrity of the assemblage of a disposable beverage cup, made of any plausible material, fitting any commercially available, disposable beverage cup lid.

The present invention comprises a ledge around a beverage cup's circumference just below where a lid affixes to the cup and high enough up the cup wall to allow the top plane of the ledge to be either in contact or almost in contact with the lid skirt edge when the lid is fully engaged to the cup. The ledge's outside diameter is slightly greater than the outside diameter of the lid skirt edge. The ledge guards the lid skirt edge against being contacted by human fingers and thumb, and against being struck by outside objects. That guarding effect improves the reliability of the lid-cup combination throughout the cup's use from its filling to consumption of the contained beverage. The ledge also acts as a more effective means of grasping the filled, lidded cup for handling and manipulation. The cup of this invention also comprises a digit or thumb size indentation along the circumference of the ledge to allow controlled, safe removal of the lid from the cup.

It is an object of the invention disclosed herein to provide a disposable hot beverage cup comprising a ledge projecting radially outward around an upper portion of the outside surface of the cup. The ledge serves as a physical guard preventing contact between the human hand or other objects and the lowest outside edge of a beverage cup's disposable lid when the lid is affixed to the cup. In essence, the ledge of the present invention comprises a curb to stop the upward motion of the human hand carrying the cup or lifting it during the act of beverage consumption.

It is another object of this invention to provide a ledge which structurally maintains and reinforces the original cross-sectional shape and volume of the cup with or without a lid affixed to it.

It is another object of this invention to form and position the ledge element ergonomically for optimal carrying, handling and manipulation of the cup and lid assemblage during serving, transporting and consuming of the beverage contained in the lidded cup.

It is another object of this invention to allow controlled removal of the lid from the cup by providing a means for an element or elements of the human hand to contact a limited part of the circumference of the lid's skirt.

DETAILED DESCRIPTION OF THE INVENTION

Figure 1:
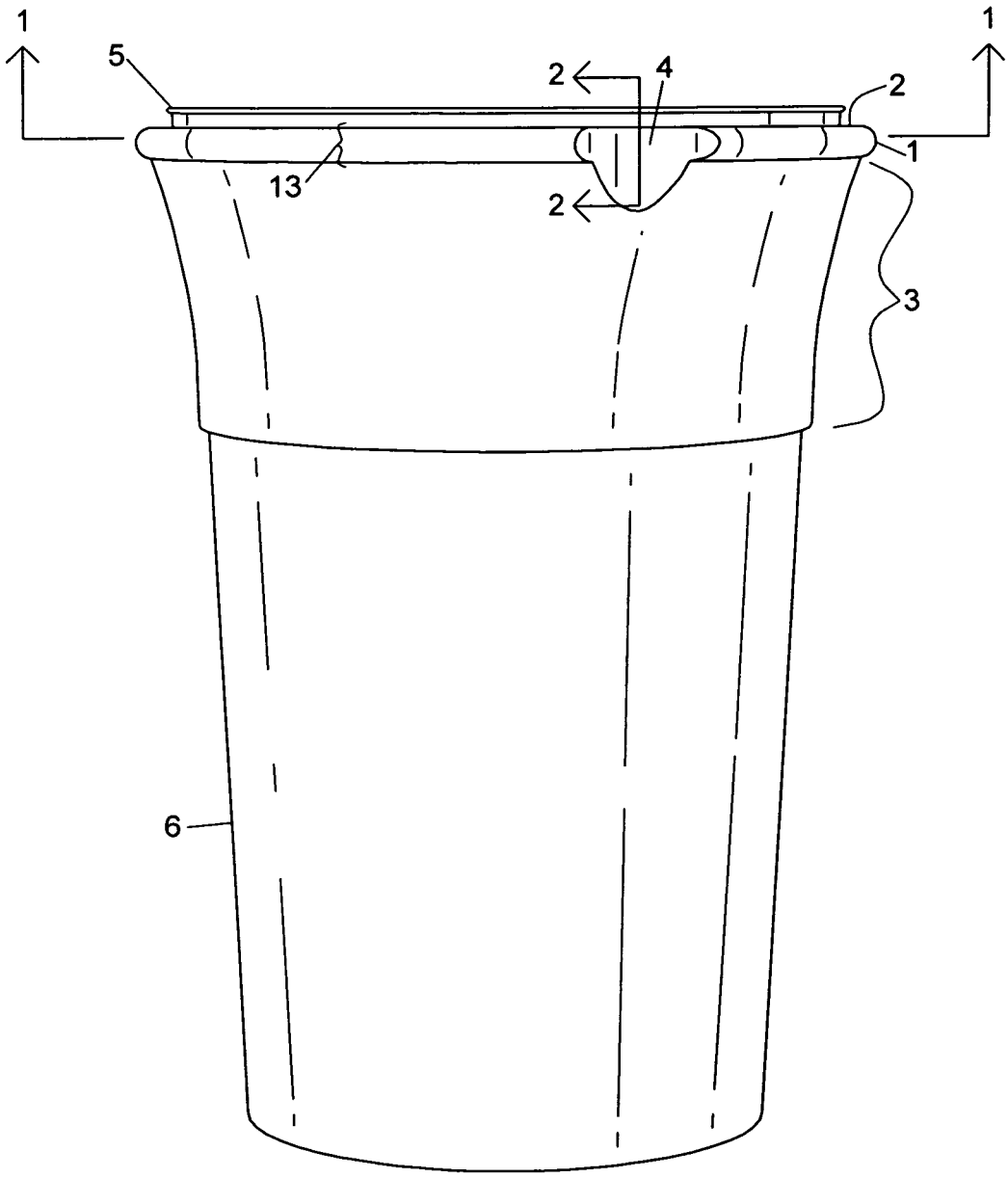
FIG. 1 illustrates a front elevational view of the preferred embodiment of the invention.

The invention disclosed herein integrates structural elements of a disposable beverage cup that can be manipulated while practically eliminating or lowering the risk of an affixed beverage cup lid being inadvertently or accidentally detached from the cup. The resulting structure minimizes or eliminates a well-known hazard to the beverage consumer and others while enhancing the ergonomics of the cup and lid assembly.

The present invention comprises a disposable beverage cup capable of receiving a disposable lid of the types commonly commercially available. The cup can be made of any common material for beverage cups, but the preferred embodiments are manufactured from resin-covered paper or Styrofoam®. The cup can be manufactured in various heights and diameters.

While not part of the invention, the beverage cup of the invention is designed to function with a commercially available disposable lid. Such lids are manufactured in varying diameters, depending on the size of cup they are intended to cover. The lids are circular, comprising a planar, raised or semi-circular body and a skirt around the outer circumference, capable of being press fit over the rim of a disposable cup. The lid is removed by upward pressure on the skirt.

The cup comprises an outside surface, an inside surface, a top, which is open and characterized by a rim, and a bottom, which is closed. The bottom may further comprise a rim around its outer circumference to enhance stability and prevent over-insertion of others cups when stacked. The cup further comprises a body, which comprises a grasping portion, where a user commonly holds the cup and a ledge. The ledge is a seamless, monolithic protrusion formed concentrically about the vertical axis of, and occurring below, the rim of the cup. The ledge comprises a rounded curb adjacent to the grasping portion of the cup, which terminates in a horizontal plane that protrudes from the outside surface of the cup coaxially about the cup's axis, the horizontal plane's outer circumference being concentric with and greater than the outer circumference of the lid. The ledge further comprises a contour, which can be seen in the cup's cross-section, merging the cup's circumference about the vertical axis of the cup with the ledge to improve human grip and safe manipulation of the cup. The ledge further comprises one or more indentations in the curb and horizontal plane, shaped to allow contact between the lid's skirt and the user's fingers and/or thumb. Each of the elements is described in greater detail as follows:

The ledge is a monolithic element that concentrically surrounds the upper portion of the cup to act as a barrier between the grasping portion of the cup and the cup's rim and lid. The ledge is capable of stopping the user's hand from slipping upward from the grasping portion of the cup towards the rim of the cup. The ledge's ability to prevent the user's hand from contacting the lid's skirt, minimizes or eliminates the risk of the hand accidentally and inadvertently detaching the lid suddenly from the cup, which could result in a potentially hot beverage erupting from the cup. The ledge also guards against the accidental and inadvertent detachment of the lid which commonly results in spillage onto furniture, electronics, appliances, automobile dashboards, automobile cup carriers, gearshifts, and other objects that might come in the path of a cup and lid assembly while it is being manipulated or transported by the server and consumer of the contained beverage.

The ledge comprises a rounded curb that acts as a barrier to upward movement of the hand. The curb terminates in a horizontal plane which comprises a flat surface which extends concentrically inward from the curb to a diameter similar to or the same as the cup's rim, resulting in a circumference greater than the outer lowest circumference of the lid's skirt. The horizontal plane is located sufficiently close to the cup's rim so that it abuts the bottom edge of the lid's skirt. In an alternative embodiment of the invention, the horizontal plane is located lower on the cup's body by an amount equal or less than the full elastic vertical deflection of the ledge if it were subjected to a sudden impact, resulting in a gap between the horizontal plane and the skirt's lowest point.

The cross-sectional contour of the outside surface of the cup from the grasping portion to the ledge is either a linear or curvilinear change in angle, so that the user can grasp the cup under the ledge ergonomically, safely and comfortably. In two separate embodiments of the invention, the contour either gradually or abruptly changes in angle from the grasping portion of the cup to the ledge depending on the ergonomic or manufacturing considerations.

The indentations comprise an interruption of the continuity of the ledge's circumferential form that allows the lid skirt edge to be contacted by an element, i.e., finger or thumb, of the human hand for the purpose of controlling removal of the lid from the cup.

The preferred embodiment of the invention, as described above, is manufactured from expandable materials such as Styrofoam® or gasified natural fibrous slurries made of natural or synthetic resins stabilized by natural or synthetic starches or proteins. In the primary alternative embodiment depicted in FIGS. 6 and 7, the invention is manufactured from a flat material such as coated and or infused paper that is rolled and pressed to form the cup. The invention could also be manufactured from other materials, such as polyolefin resin or plastic. Multiple differences result from the change in materials from expanded to flat. First, the cross-sectional contour is more linear, due to the limitations in thickness of paper-type materials. Second, the inside surface of a cup made of expandable material may still be uniform and linear, despite the presence of the ledge on the outside surface thereby allowing the majority of a cup to be inserted into another for stacking of multiple cups for cost effective shipping. The inside surface of the cup manufactured from rolled flat materials has a depression that corresponds to the ledge on the outside surface.

FIG. 1 is a frontal elevation of the invention showing: curb (1); horizontal plane (2); contour (3); indentation (4); cup rim (5); and the cup (6). Elements (1) through (5) are combined as a monolithic form comprising the invention. FIG. 1 depicts the preferred embodiment of the invention manufactured from expandable materials such as Styrofoam® or gasified natural fibrous slurries made of natural or synthetic resins stabilized by natural or synthetic starches or proteins.

Figure 2:
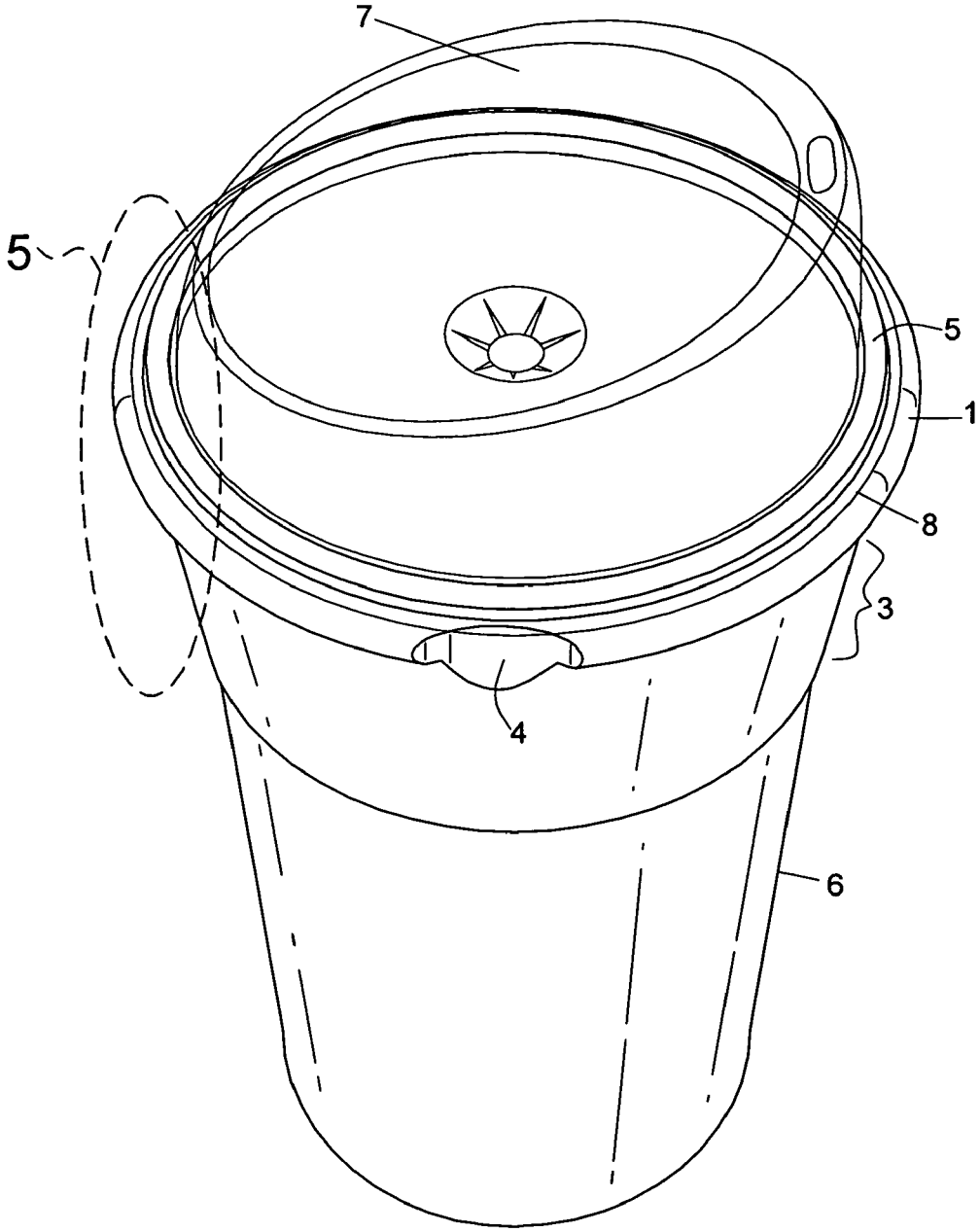
FIG. 2 illustrates a perspective view of the preferred embodiment illustrated in FIG. 1 with the addition of a type of lid affixed to the preferred embodiment of the invention. The lid is not claimed as part of the invention.

FIG. 2 is frontal-top perspective of the preferred embodiment of the invention with the addition of a commercially available disposable cup lid (7) affixed to the cup's rim (5) which is of the press fit type commonly used in the field of this invention. The alternative type of lid to cup fit is a rounded skirt fit that is described in FIGS. 6 and 7. The curb (1) is shown to have its outside diameter greater than that of lid skirt (8). The ledge (13) therefore guards against contact between objects and the lid skirt (8), thereby preventing or reducing the risk of inadvertent, accidental, sudden detachment of the lid (7) from the cup (6). The lid skirt (8) can be in contact with horizontal plane (2) or be slightly above it, say 1/10"±, to a degree that maintains the barrier relationship between the ledge (13) and the lid skirt (8). The indentation (4) allows for a digit or thumb of the human hand to make intentional controlled contact with the lid skirt (8) for intentional controlled removal of the lid (7) from the cup (6) via upward pressure with a finger or thumb. The inside surface (9) of the Cup (6) is uniform, relative to the protruding ledge (13) on the outside surface (10), and is a characteristic example of a common cup formed with expandable natural or synthetic resins such as Styrofoam® or gasified natural fibrous slurries stabilized with organic starches or proteins.

Figure 3:
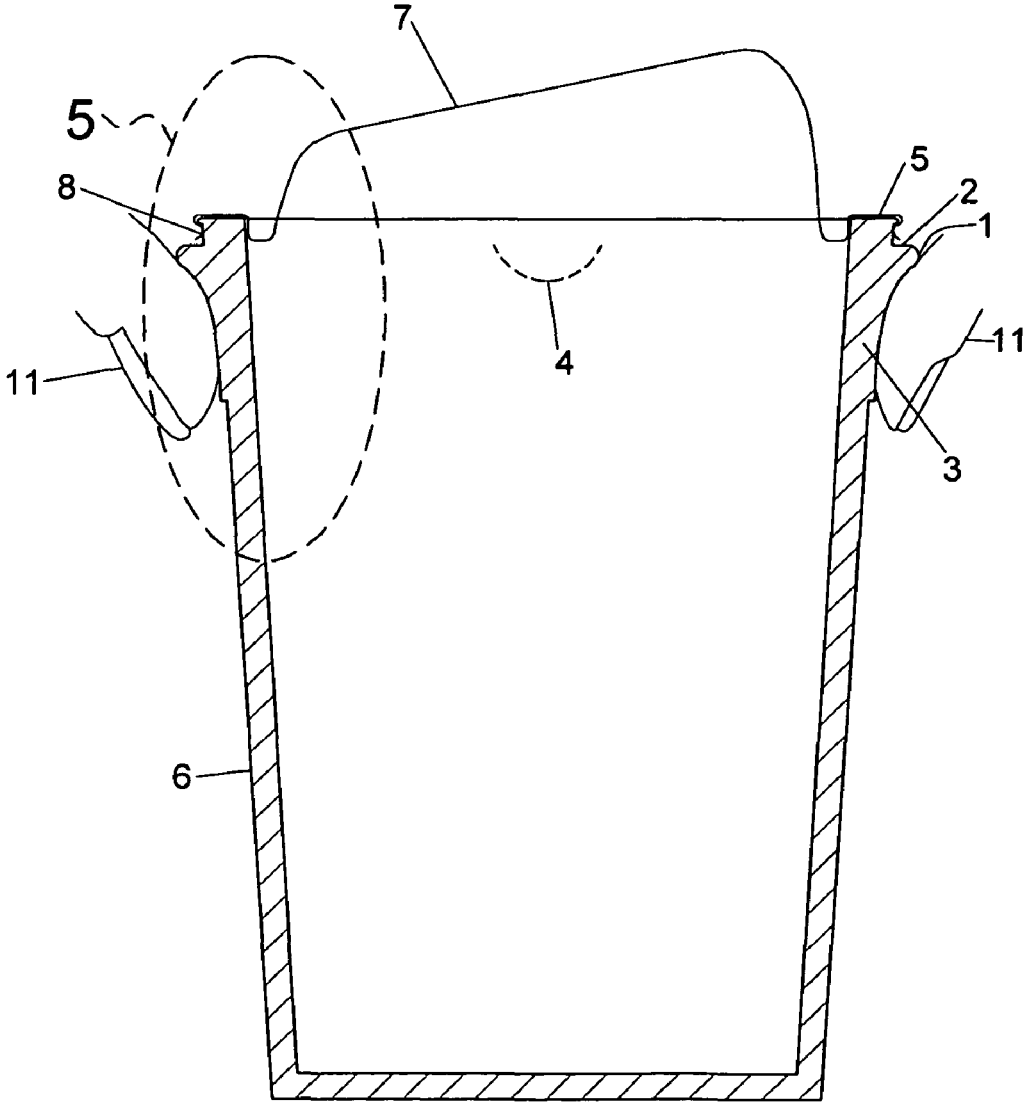
FIG. 3 illustrates an elevational cross-sectional view of the preferred embodiment of the invention being handled by elements of the human hand.

FIG. 3 is frontal view cross-section of the preferred embodiment of the invention. Finger(s) and thumb (11) are shown grasping the cup (6) at opposite points along the cross-sectional contour (3) that stops or curbs the finger(s) and thumb (11) from contacting the lid skirt (8), thereby preventing or reducing the risk of the inadvertent, accidental, sudden detachment of the lid (7) from the cup (6). It is a common habit or practice of servers and consumers to grasp lidded cups in similar manner shown herein. Commercially available disposable cups allow the finger and thumb and other objects to contact and exert upward force on the lid, thereby causing potential inadvertent, accidental, sudden removal of the lid from the cup.

Figure 4:
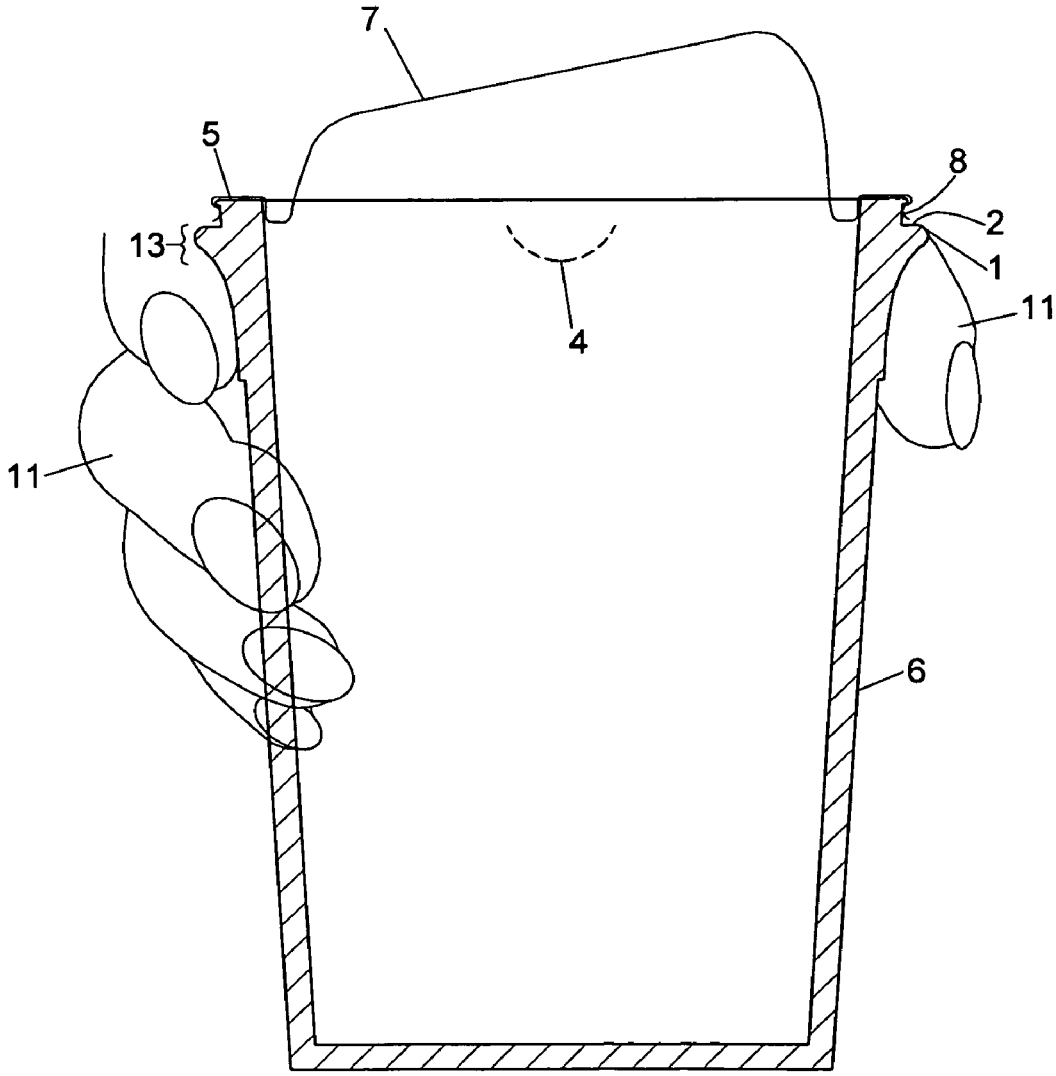
FIG. 4 is the same view as FIG. 3 except that elements of the human hand are positioned for the act of drinking from the preferred embodiment.

FIG. 4 is frontal view cross-section of the preferred embodiment of the invention. All four fingers and thumb (11) are shown grasping the cup (6) around its outside surface. The ledge (13) stops or curbs objects and elements of the human hand, i.e., finger(s) and thumb (11) from contacting and exerting upward force on lid skirt (8), thereby preventing or reducing the risk of the inadvertent, accidental, sudden detachment of the lid (7) from the cup (6). The manner in which the human hand grasps the cup (6) depicted in FIG. 4 is common with consumers in the act of drinking the contained beverage.

Figure 5:
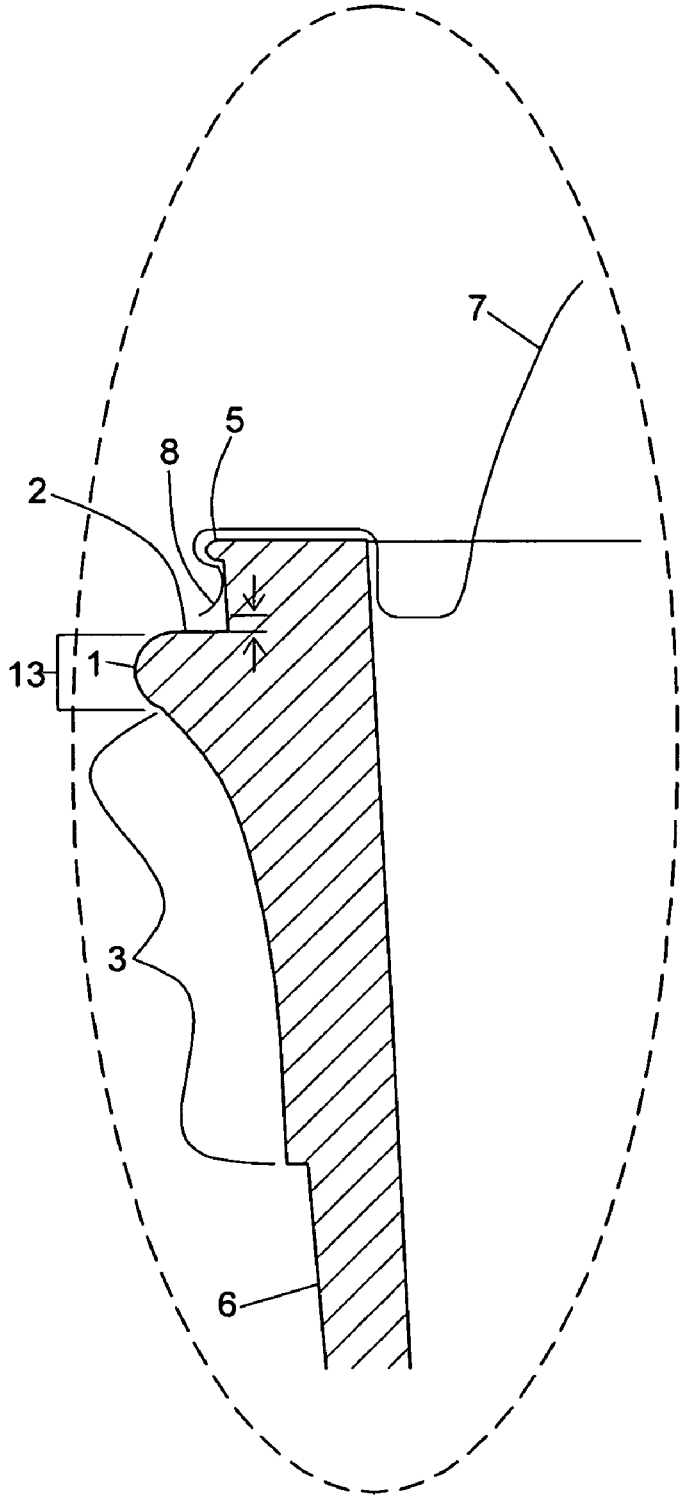
FIG. 5 is a larger scale detail of a section of the preferred embodiment of the invention.

FIG. 5 is an enlarged detail of the upper left cross-sectional frontal view of the invention with a common lid (7) affixed. The lid (7) press fits onto the cup's rim (5). The cross-section of the expanded resin embodiment of the cup is depicted. FIG. 5 depicts an alternative embodiment wherein the lid skirt (8) does not make contact with horizontal plane (2), as it does in FIG. 4. The curb (1), and therefore horizontal plane (2), is positioned lower relative to the cup's rim (5), than in FIG. 4 such that additional separation is created between lid skirt (8) and the horizontal plane (2), preventing or reducing the risk of elastic deflection of the ledge (13) from transmitting upward force against lid skirt (8). The uniformity of the inside surface (9) is clearly depicted in FIG. 5, demonstrating a common result of the manufacture of expanded resin cups. This effect differs from rolled and pressed flat paper or natural resin cups depicted in FIGS. 6 and 7. The curvilinear contour (3) is more a function of ergonomics, but the invention's contour can range from curvilinear to linear. The curvilinear contour (3) is more practicably applied to forming expanded resin cups, whereas the linear contour (3) as shown in FIGS. 6 and 7, is more practicably applied to forming rolled and pressed flat material such as paper.

Figure 6:
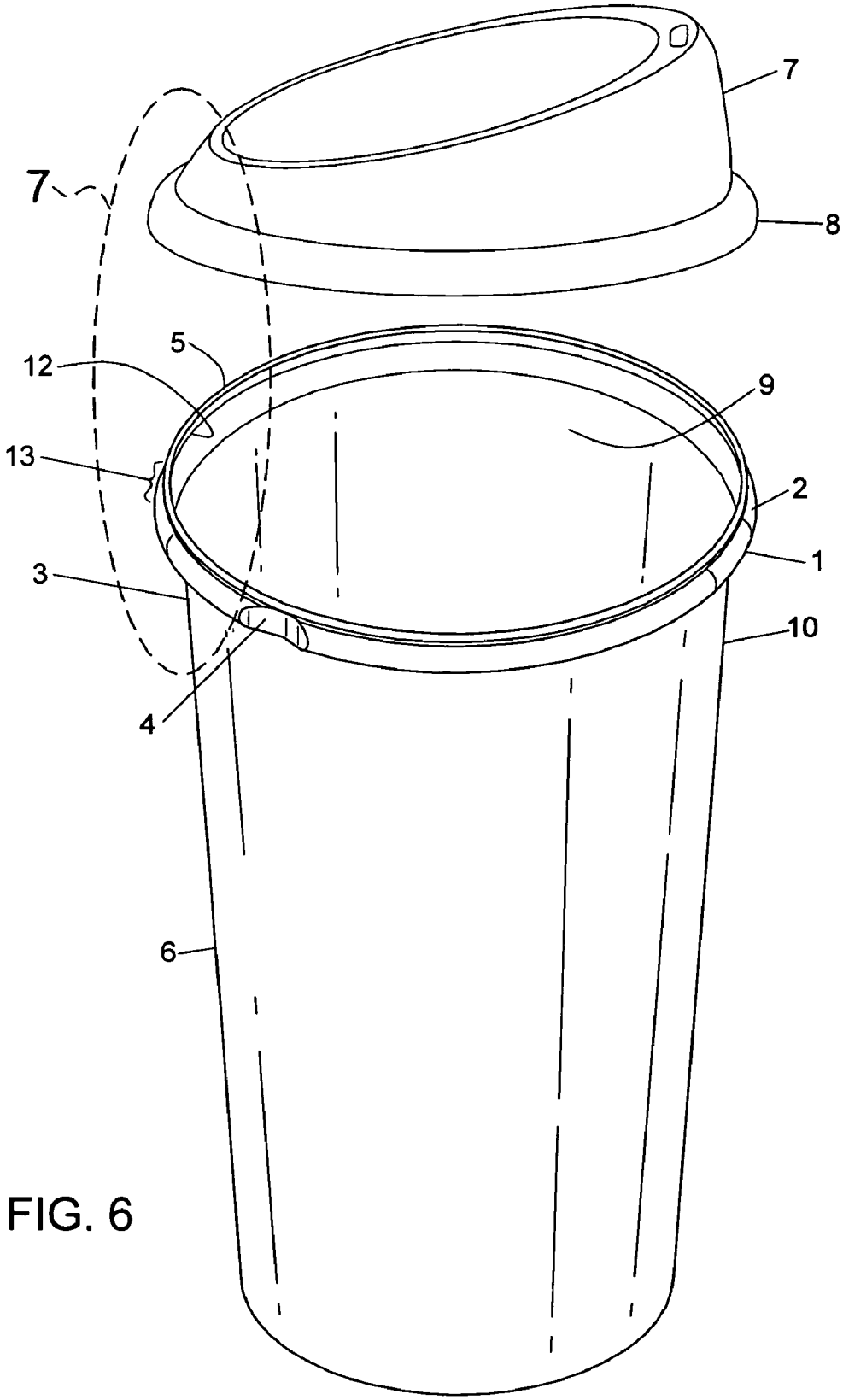
FIG. 6 illustrates a perspective view of an alternative embodiment of the invention. The lid is not claimed as a part of the invention.
Figure 7:
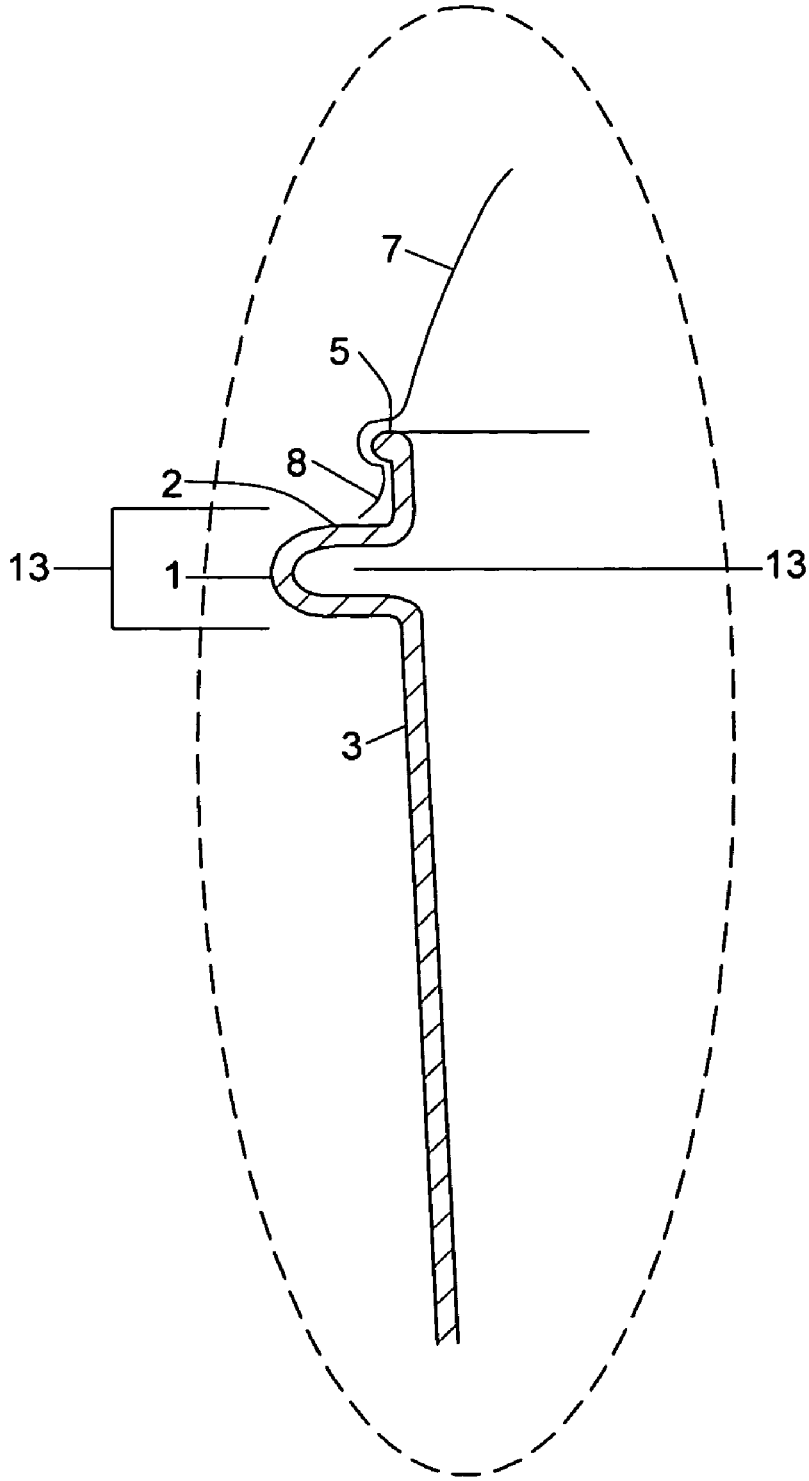
FIG. 7 is a larger scale detail of a section of an alternative embodiment of the invention.

FIG. 6 is a frontal perspective view of the alternative embodiment of the invention, formed from a common type of flat material such as coated and or infused paper that is typically rolled and pressed to form the cup. The lid (7) is not a part of this invention but is included in the figures to demonstrate the functional aspects of the invention elements relative to common lids. The lid's skirt (8) mates with cup's rim (5), which is rolled. The ledge (13) stops or curbs contact between elements of the human hand and the lid skirt (8) in the same manner described in FIGS. 3 and 4. The cross-sectional contour (3) is simply a linear continuation of the contour of the primary shape of the cup (6). In alternative embodiments, the linear contour (3) can be at any logical angle from the primary shape of the cup. The ledge (13) comprises a curb (1) and a horizontal plane (2). A rolled and pressed or otherwise formed depression (12) is formed on the inside surface (9) of the cup, corresponding to the ledge (13) on the outside surface (10) of the cup. The indentation (4) and the depression (12) demonstrate the different characteristics of a cup manufactured from a rolled flat material versus an expanded resin material.

FIG. (7) shows, in a larger scale, a detail of the alternative embodiment of the invention manufactured from rolled flat materials.

Figure 8:
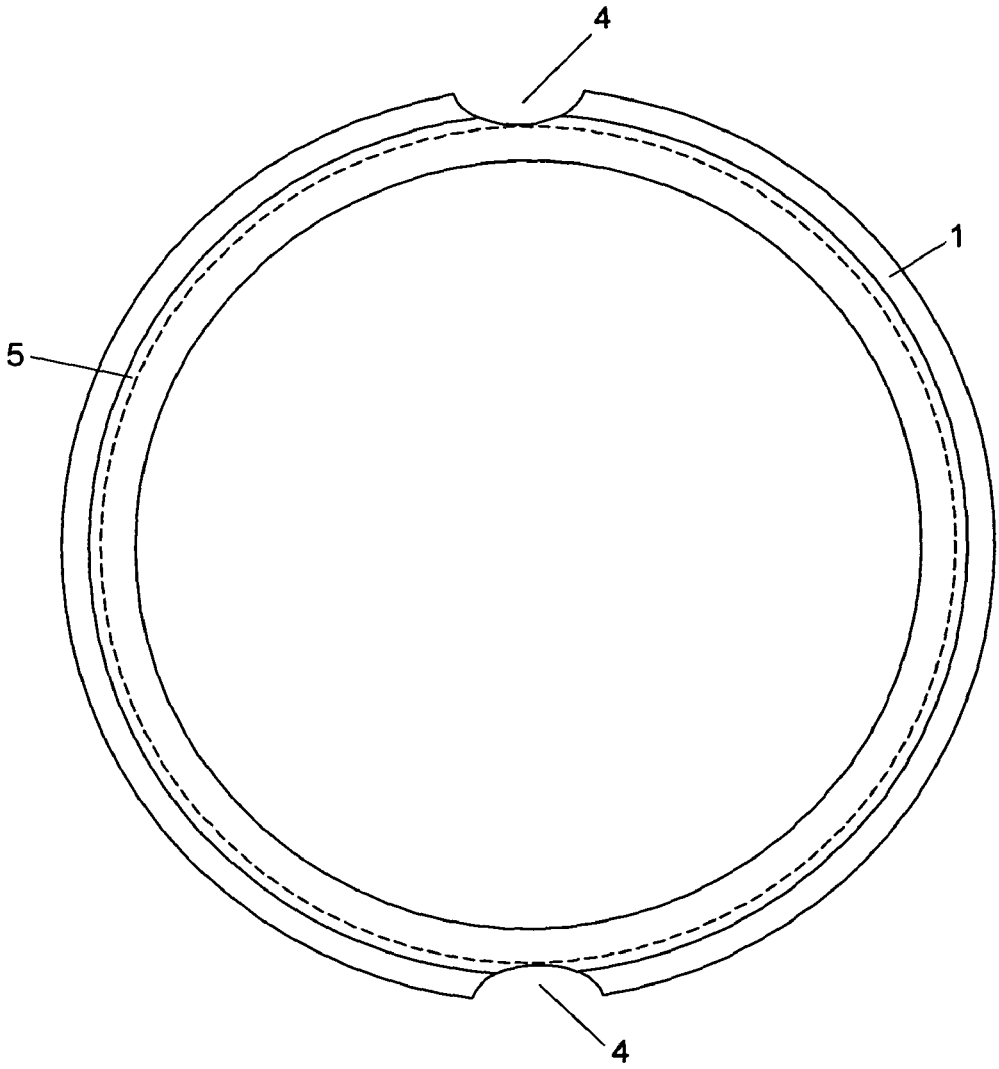
FIG. 8 is a top view of the invention showing the curb (1), the multiple indentations (4), and the rim (5).

FIG. 8 is a top view of the invention in which there are two indentations (4) that project inwardly through the curb (1). Alternative embodiments may have various numbers of indentations, which facilitate removal of a lid from the cup.

Figure 9:
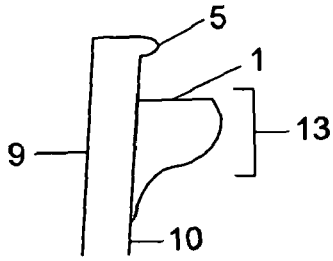
FIG. 9 is a vertical cross-sectional view of a portion the cup showing the inner surface (9) and outer surface (10), and further depicting a cross-section of the rim (5) and the ledge (13).

FIG. 9 is a cross-sectional view of one side of the upper portion of the cup. That figure illustrate the cross-sectional, structural and spatial relationship between the rim (5), curb (1), inside surface (9), outside surface (10) and the ledge (13).

What we claimed is:

1. A disposable beverage cup, comprising:

a. a top, the top comprising an opening and a rim; the opening comprising a center point and a vertical axis running through the center point;

b. a bottom;

c. an inside surface;

d. an outside surface, the outside surface comprising a grasping portion and a ledge, the ledge being radial, seamless, monolithic, and concentrically located about the vertical axis of, and projecting outwardly between the rim and the grasping portion of the cup, the ledge being capable of preventing contact between a cup user's hand or other objects and a disposable lid when the lid is affixed to the cup's rim, the ledge further being capable of structurally maintaining and reinforcing the cup's structural integrity with or without a lid affixed to it, the ledge being ergonomically positioned for optimal carrying, handling and manipulation of a cup and lid assemblage during serving, transporting and consuming of a beverage contained in a lidded cup, the ledge comprising:

i. a curb capable of stopping the upward motion of a user's hand towards the cup's rim while carrying or lifting the cup; the curb terminating in a horizontal plane protruding from the outside surface of the cup coaxially about a common cup's axis, the horizontal plane comprising an outer circumference, the horizontal plane's outer circumference being concentric with and greater than a cup lid's outer circumference when a cup lid is affixed to the cup;

ii. one or more indentations comprising a recess projecting inwardly through the curb and horizontal plane, the indentations being capable of allowing contact between the lid and a user's fingers; and e. a cross-sectional contour located between the curb and the grasping portion, the cross-sectional contour being capable of merging the cup's outer circumference concentrically about the cup's vertical axis with the ledge so that the user's grip and safe manipulation of the cup is greatly improved.

2. A disposable beverage cup according to claim 1, wherein the cup is manufactured from a rolled flat material, the inside surface of the cup comprising a depression corresponding to the inside of the ledge on the outside surface of the cup, the depression resulting from the flat material from which the cup is manufactured.

* * * * *